US006968597B2

(12) United States Patent
Habegger et al.

(10) Patent No.: US 6,968,597 B2
(45) Date of Patent: Nov. 29, 2005

(54) HINGE ASSEMBLY HAVING IMPROVED STOP

(75) Inventors: Jeffrey D. Habegger, Wadsworth, OH (US); Steven O. Cummins, Mansfield, OH (US)

(73) Assignee: Mansfield Assemblies Co., Mansfield, OH (US)

( * ) Notice: Subject to any disclaimer, the term of this patent is extended or adjusted under 35 U.S.C. 154(b) by 0 days.

(21) Appl. No.: 10/452,869

(22) Filed: Jun. 2, 2003

(65) Prior Publication Data

US 2003/0221285 A1 Dec. 4, 2003

Related U.S. Application Data

(60) Provisional application No. 60/384,958, filed on May 31, 2002.

(51) Int. Cl.[7] ..... E05F 1/08

(52) U.S. Cl. ..... 16/297; 16/289; 16/343; 16/332; 126/194

(58) Field of Search ..... 16/343, 321, 362, 16/374, 331, 332, 289, 297; 49/386, 387; 126/190–194

(56) References Cited

U.S. PATENT DOCUMENTS 3,327,701 A * 6/1967 Smith ..... 126/194
3,677,259 A * 7/1972 Doner ..... 126/194
3,712,287 A * 1/1973 Summers, Jr. ..... 126/191
3,749,080 A * 7/1973 Kleinhenn ..... 126/191
3,838,528 A * 10/1974 Burford ..... 49/258
3,842,542 A * 10/1974 White et al. ..... 49/386
4,400,848 A * 8/1983 Grass ..... 16/332
4,665,892 A 5/1987 Spargo et al.
4,817,240 A * 4/1989 Sovis, Jr. et al. ..... 16/297
5,025,776 A 6/1991 Hanley et al.
5,341,542 A * 8/1994 Hannan et al. ..... 16/289
6,453,510 B1 * 9/2002 Cummins et al. ..... 16/343

* cited by examiner

*Primary Examiner*—Chuck Mah
*Assistant Examiner*—Michael J Kyle
(74) *Attorney, Agent, or Firm*—Fay, Sharpe, Fagan, Minnich & McKee, LLP

(57) ABSTRACT

A hinge assembly for an appliance comprises a channel and a stop connected to the channel. A door mounting lever pivots relative to the channel about a pivot axis on an arc between a first operative position where the door mounting lever is moved a maximum extent in a first direction about said pivot axis on the arc and second operative position where the door mounting lever is moved a maximum extent in a second direction opposite the first direction about the pivot axis on the arc. A glide is operatively coupled to the door mounting lever, e.g., by way of a spring cam member, and is movable slidably on the stop in response to movement of the door mounting lever. A spring biases the glide into continuous engagement with the stop when the door mounting lever is located in both the first and second operative positions and when the door mounting lever moves between the first and second operative positions.

18 Claims, 8 Drawing Sheets

HINGE ASSEMBLY HAVING IMPROVED STOP

This applications claims priority from and benefit of the filing date of U.S. provisional application 60/384,958 filed May 31, 2002.

BACKGROUND OF THE INVENTION

The present invention relates to appliance hinge assemblies for operatively connecting an appliance door to an appliance body. Hinge assemblies of the type disclosed herein are often employed in pairs and facilitate movement of the appliance door to and between a fully closed position and a fully opened position. Such hinge assemblies typically comprise a door mounting lever to which the appliance door is connected and biasing means such as a tension or compression spring for biasing the door mounting lever into a first position corresponding to the fully closed position of the associated door. The door mounting lever and door connected thereto are manually movable against the biasing force of the spring from the first position to a second position that corresponds to the fully opened position of the door, at which position the weight of the door is sufficient to resist the biasing force of the spring so that the door remains in the fully opened position without continued application of manual opening force to the door. To provide a partially opened position for the door, such as a "broil" position for an oven door, these hinge assemblies typically comprise a stop member that inhibits movement of a mating glide at a select point which, in turn, inhibits pivoting movement of the door mounting lever under force of the spring toward its first operative position at a desired intermediate position corresponding to the broil position for the door.

In a typical arrangement, the door mounting lever is pivotally connected to a channel, and a glide slides along an inner surface of the channel when the door mounting lever pivots relative to the channel. The stop is typically defined from molded plastic and is connected to the channel at a desired location so that the glide encounters the stop when the door mounting lever is in the desired partially opened (intermediate) position. This conventional design has enjoyed widespread commercial success. On the other hand, it has been deemed desirable to enhance this conventional design by providing a hinge assembly exhibiting smooth operation and increased durability, even when a high force biasing spring is utilized as is becoming increasingly popular for overall hinge and door performance.

More particularly, conventional designs typically require the glide to transition repeatedly from the channel to the stop. This transition can reduce smoothness of hinge operation and can loosen or damage the stop, especially when the stop is made from plastic and/or when high force springs are used in an effort to improve hinge "feel" and performance.

In light of the foregoing deficiencies and others associated with conventional hinge assembly designs, a need has been identified for a hinge assembly having an improved stop that exhibits improved feel, counterbalance and durability.

SUMMARY OF THE INVENTION

In accordance with the present invention, a hinge assembly comprises a channel and a stop connected to the channel. A door mounting lever pivots relative to the channel about a pivot axis on an arc between a first operative position where the door mounting lever is moved a maximum extent in a first direction about said pivot axis on the arc and second operative position where the door mounting lever is moved a maximum extent in a second direction opposite the first direction about the pivot axis on the arc. A glide is operatively coupled to the door mounting lever and is movable slidably on the stop in response to movement of the door mounting lever. A spring biases the glide into continuous engagement with the stop when the door mounting lever is located in both the first and second operative positions and when the door mounting lever moves between the first and second operative positions.

In accordance with another aspect of the present invention, an appliance hinge assembly comprises a channel adapted for connection to an appliance chassis. The channel comprises a main channel member comprising first and second ends and defining a recess. A stop is located in the recess of the main channel member. The stop comprises a glide surface spaced from the main channel member. A door mounting lever is provided and adapted for connection to an appliance door. The lever is movable relative to said channel about a pivot axis. A glide operably is coupled to the door mounting lever and moves slidably on the glide surface of the stop in response to movement of the door mounting lever relative to the channel. At least one spring is provided for biasing the door mounting lever to a first operative position and for biasing the glide into abutment with the glide surface of the stop for all pivoting operative movement of the door mounting lever about the pivot axis.

In accordance with a further aspect of the present invention, a hinge assembly comprises a channel comprising first and second axially spaced-apart ends. A door mounting lever is pivotally connected to the channel for pivoting movement about a pivot axis on an arc between a first operative position and a second operative position. A spring cam member is connected to the door mounting lever. A glide is located at a first end of the spring cam member. A stop is connected to the channel and comprises a glide surface. The glide moves slidably on the glide surface and is in continuous contact with the glide surface when the door mounting lever moves to and between the first and second operative positions on the arc.

BRIEF DESCRIPTION OF THE DRAWINGS

A hinge assembly formed in accordance with the present invention comprises various components and arrangements of components, a preferred embodiment of which is illustrated in the accompanying drawings that form a part hereof and wherein.

DETAILED DESCRIPTION OF PREFERRED EMBODIMENT

Figure 2:
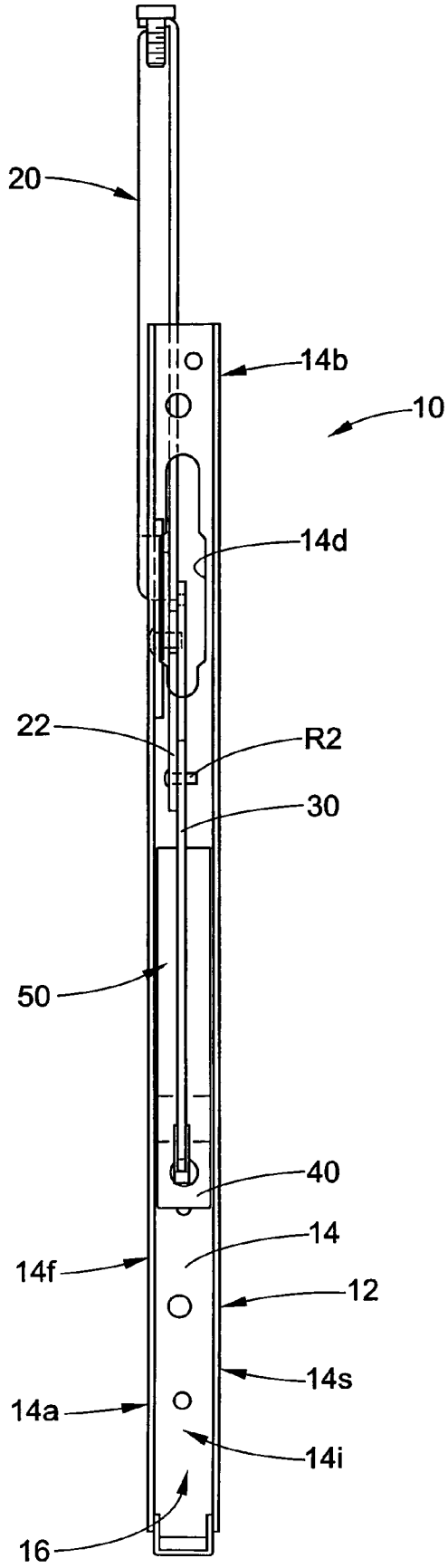
FIG. 2 is an elevational view taken along line 2—2 of FIG. 1 (the biasing spring is omitted for clarity)

Referring now to the drawings, a hinge assembly 10 formed in accordance with the present invention comprises a base or channel 12 adapted for being secured to an appliance frame or chassis C. The channel 12 comprises an elongated main channel member 14 having opposite first and second ends 14*a*, 14*b* separated from each other along a longitudinal axis. In a preferred embodiment, the main channel member is conformed to include a C-shaped or U-shaped cross section defined by an inner wall 14*i*, and first and second spaced-apart sidewalls 14*f*, 14*s* (FIG. 2) that project outwardly from the inner wall 14*i* so that a recess 16 is defined between the inner wall 14*i* and the first and second sidewalls 14*f*, 14*s*.

Figure 1:
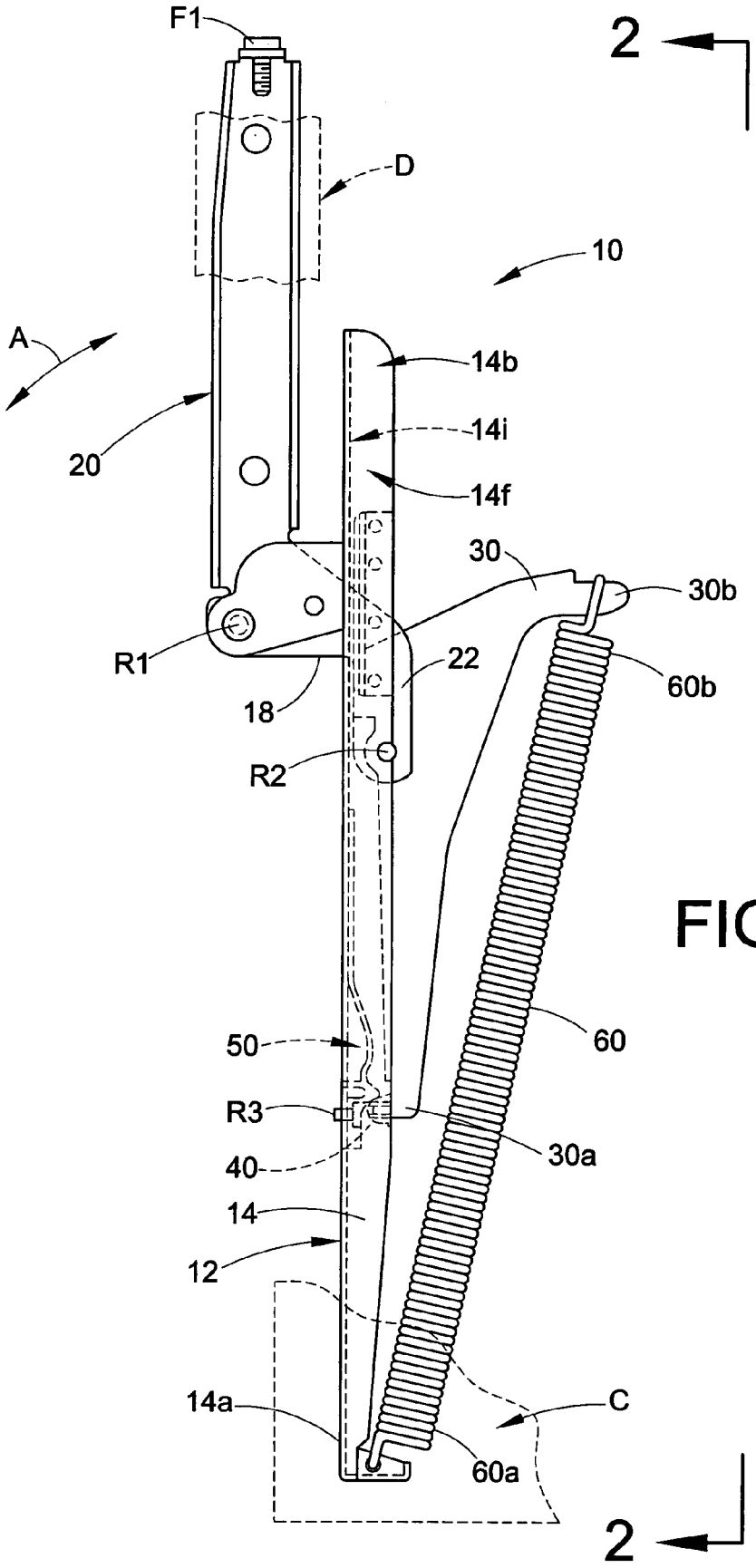
FIG. 1 is a side elevational view of a hinge assembly formed in accordance with the present invention (the biasing spring is shown diagrammatically for clarity)

A door mounting lever 20 is pivotally connected to the channel member 14. As shown, the channel 12 preferably comprises a tab 18 connected to or formed as a one-piece construction with the main channel member 14. The tab 18 provides a location to which a door mounting lever 20 is pivotally connected to the channel member 14 by a fastener R1 such as a rivet, pin or the like. The door mounting lever 20 is adapted for being secured to an associated appliance door D by a fastener F1 or any other suitable convenient means. The door mounting lever 20 and door D connected thereto pivot about the fastener R1 on an arc A relative to the channel 12 to and between a first operative position (FIG. 1), where, in the example where the hinge assembly 10 is used as part of an oven, the door seals a cooking chamber opening defined by the chassis, and a second operative position (FIG. 5) where the door D is fully pivoted away from the chassis C to allow free access to the cooking chamber opening. In the preferred embodiment as shown, the door mounting lever 20 is at least approximately parallel to the main channel member 14 when in the first operative position and lies transverse relative to the main channel member 14 when in the second operative position. Also, in the illustrated embodiment, the tab 18 is connected to the main channel member 14 by welding, but the tab 18 and main channel member 14 can be connected by one or more fasteners or alternative means or the channel member 14 and tab 18 can be defined together as a one-piece construction.

The main channel member 14 defines a slot 14*d* in the inner wall 14*i* (see FIG. 2), and the door mounting lever 20 comprises a tail portion 22 that projects through the slot into the recess 16. The hinge assembly 10 further comprises a spring cam member 30 that is pivotally connected to the tail portion 22 of the door mounting lever 20 by a fastener R2 such as a rivet, pin or the like. As such, pivoting movement of the door mounting lever 20 relative to the channel 12 about the fastener R1 results in movement of the spring cam member 30 axially toward and away from the first and second ends 14*a*, 14*b* of the main channel member 14. These movements are readily apparent upon comparing FIGS. 4–7 with each other. The spring cam 30 comprises first and second opposite ends 30*a*,30*b*, and the tail 22 of the door mounting lever 20 is preferably connected to the spring cam member 30 at a location generally axially between these ends 30*a*,30*b*. Furthermore, it is preferred that the first end 30*a* be located adjacent the channel member 14 while the second end 30*b* projects outwardly away from the channel member 14.

The hinge assembly 10 comprises a glide 40 operatively coupled to the door mounting lever 20. In the illustrated embodiment, the glide 40 preferably comprises a plastic member, such as a molded plastic member, that is secured to the first end 30*a* of the spring cam member 30 so as to be operatively coupled to the door mounting lever 20 via spring cam member 30. Alternatively, the glide 40 can be defined integrally or as a one-piece construction with the first end 30*a* of the spring cam member 30 as by a foot member defined by a rolled, folded or flat edge or the like.

The hinge assembly 10 further comprises a stop 50 positioned to be slidably engaged by the glide 40 for all operative positions of the door mounting lever 20 and glide 40 as described below. The stop 50 is preferably defined from a molded plastic material (i.e., a polymeric material) such as Nylon, filled Nylon or the like, but could also be defined from metal or another suitable material. The stop 50 is preferably located within the recess 16 defined by the main channel member and is fixedly secured to the inner wall 14*i* of the main channel member 14 by a fastener R3 such as a rivet or the like. The stop 50 can be secured to the main channel member 14 by any other suitable and convenient means such as a snap-fit or the like without departing from the overall scope and intent of the present invention.

Figure 8:
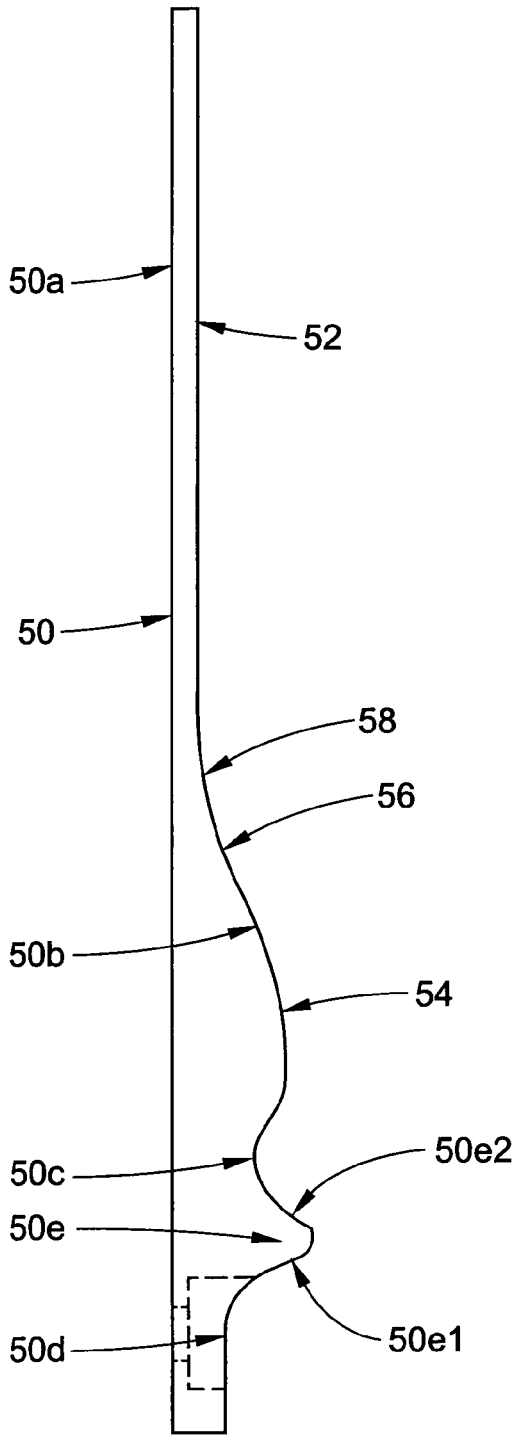
FIG. 8 is a side elevational view of a stop formed in accordance with the present invention as used in the hinge assembly shown in FIGS. 1–7; and, FIG. 9 is an isometric view of the stop shown in FIG. 8 and illustrating an associated mounting rivet.
Figure 9:
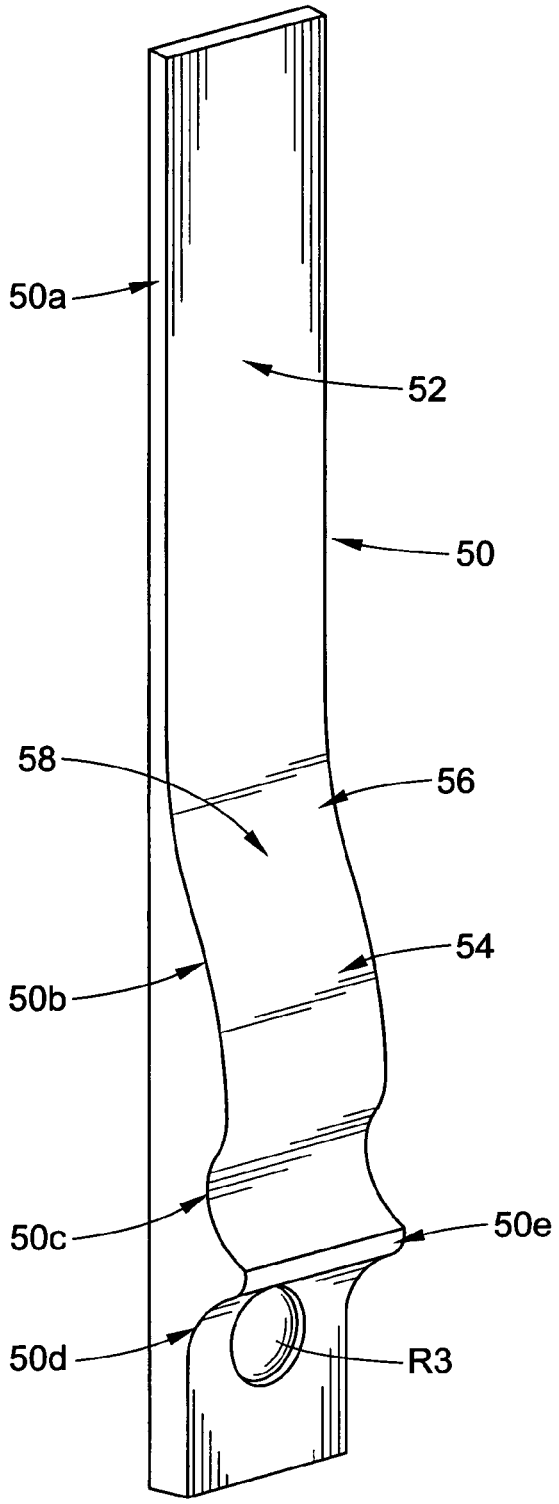

With reference also to FIGS. 8 and 9, the stop 50 comprises an elongated tail portion 50*a*, a curved camming portion 50*b*, a first dwell point or recess 50*c*, and a second dwell point or recess 50*d* (the stop 50 comprises at least one of these dwell points 50*c*,50*d*). The first and second dwell points 50*c*,50*d* are separated from each other by a peak portion 50*e*. Preferably, the elongated tail portion 50*a* defines a planar tail glide surface 52 that preferably lies parallel to the inner wall 14*i* of channel member 14. The camming portion 50*b* defines a convexly curved cam glide surface 54 that smoothly blends into the planar tail glide surface 52 by way of a concavely curved transition glide surface 56. The convexly curved cam glide surface 54 also connects with the first dwell point 50*c*. It should be noted that the fastener R3 is countersunk into the second dwell point 50*d* so that it does not interfere with sliding movement of the glide 40 on the stop 50. The glide surfaces 52, 54 and 56 cooperate to define a glide surface 58 of the stop 50.

Figure 3:
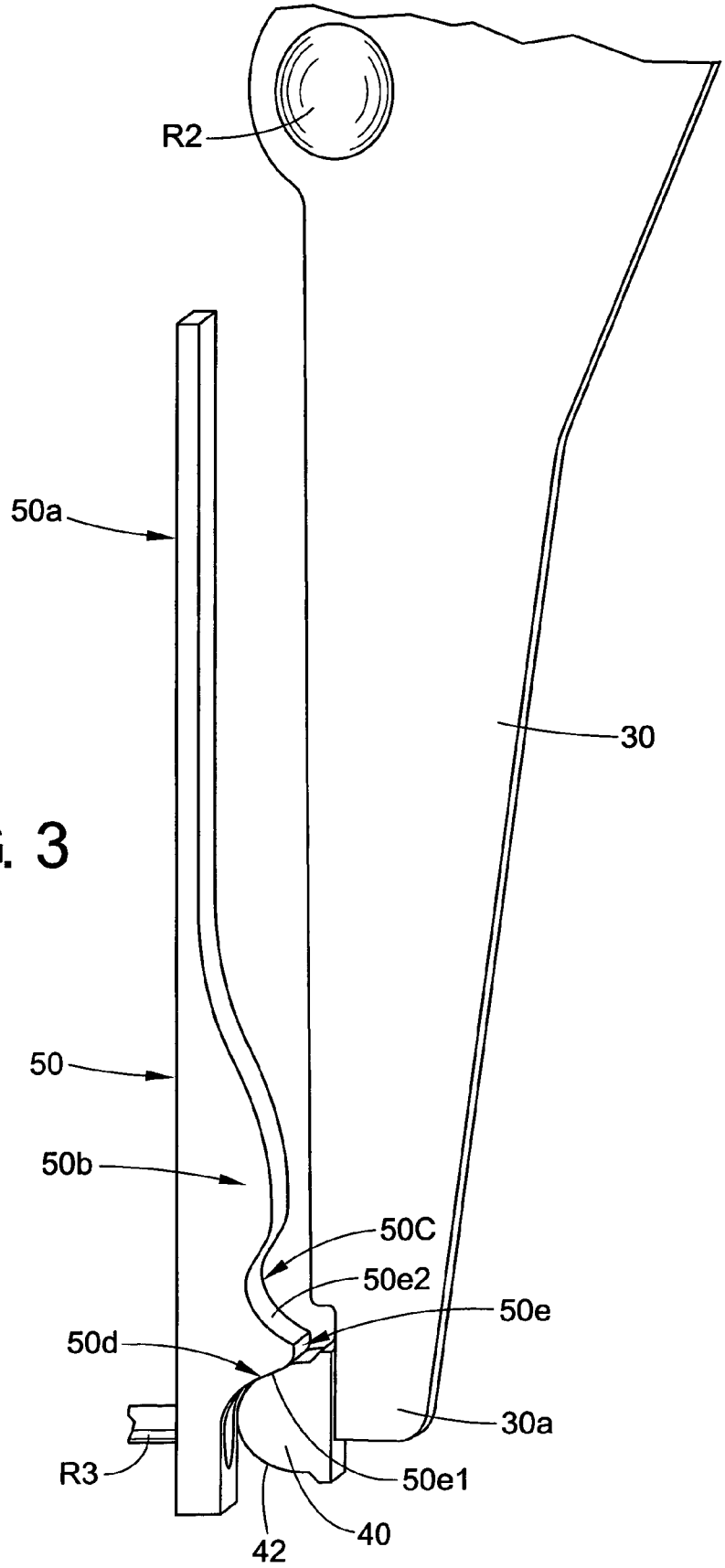
FIG. 3 is a greatly enlarged diagrammatic illustration of a glide member and stop operatively engaged in accordance with the present invention.

As shown in FIG. 3, the glide 40 preferably comprises a member defined from plastic or other material connected to the first end 30*a* of the spring cam member 30 by adhesive, over-molding, mechanical fit and/or the like. The glide 40 comprises a curved outer surface 42 that is conformed and dimensioned to slidably engage the stop 50, in particular the tail portion 50*a*, curved camming portion 50*b*, first dwell point 50*c*, second dwell point 50*d* and peak 50*e* thereof. Furthermore, the glide 40 is conformed and dimensioned so that it is at least partially received into (i.e., seats in) the dwell points 50*c*,50*d*.

Figure 4:
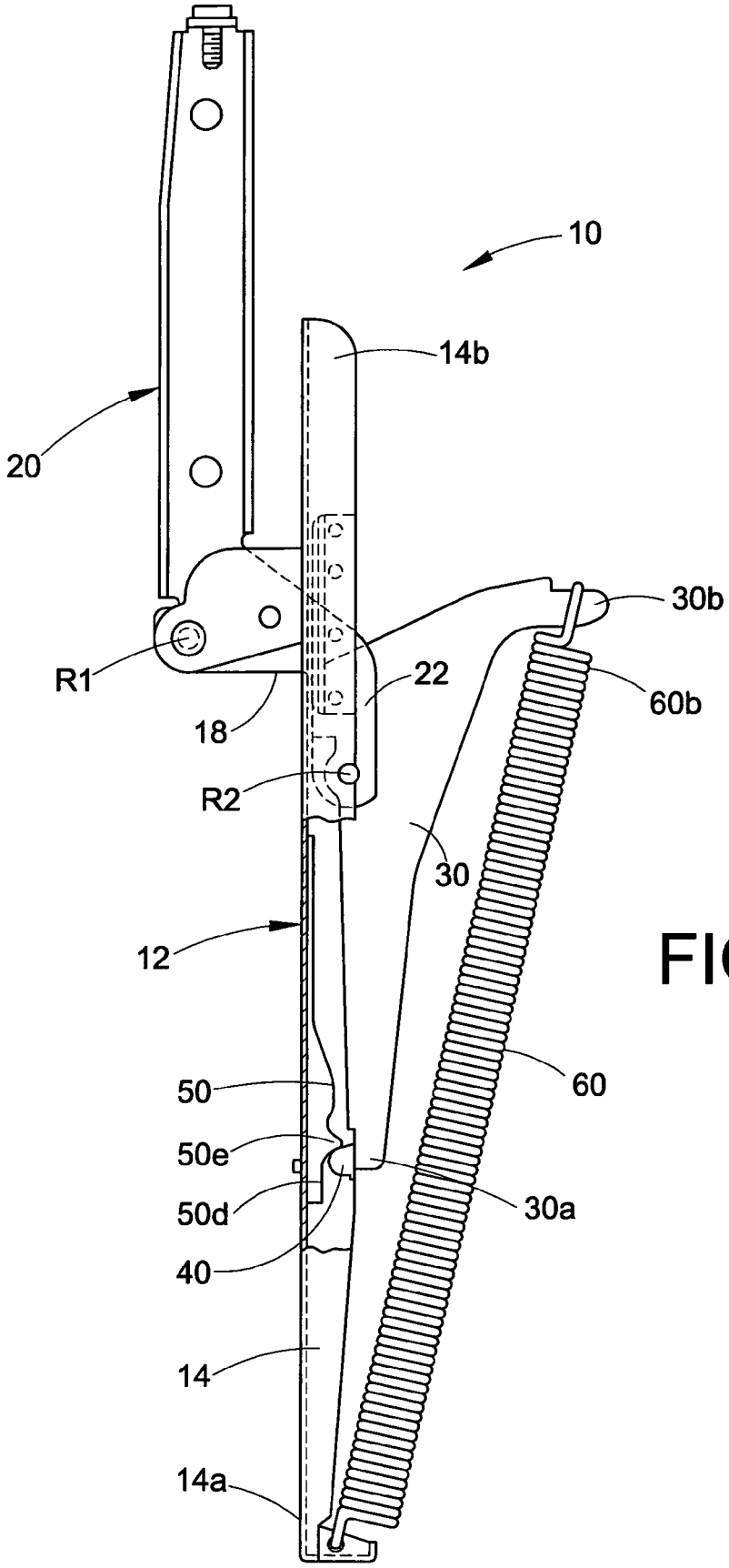
FIGS. 4–7 are side elevational view of a hinge assembly formed in accordance with the present invention (with portions of the channel member broken away) and positioned in first (closed) position, second (opened) position, third (intermediate) position and fourth (broil) positions, respectively.

Referring again to FIG. 1, the hinge assembly 10 further comprises biasing means for urging the door mounting lever 20 to its first operative position (as shown in FIGS. 1 and 4) and for maintaining the glide 40 engaged with the stop 50 for all operative positions of the door mounting lever 20. In the illustrated preferred embodiment, the biasing means comprises a tension coil spring 60 (shown diagrammatically) including a first end 60*a* secured to the channel 12 (or another fixed anchor points such as the chassis C) and a second end 60*b* secured to the spring cam member 30. Most preferably, as illustrated, the first end 60*a* of the spring is secured to the main channel member 14 adjacent the first end 14*a*, and the second end 60*b* of spring 60 is secured to the spring cam member 30 adjacent its second end 30*b*. This arrangement in combination with the location where the tail 22 of door mounting lever 20 is pivotally secured to the spring cam member 30 via fastener R2 results in the spring 60 urging (i.e., pulling) the second end 30*b* of the spring cam member 30 toward the first end 14*a* of the main channel member 14 which, in turn, results in the first end 30*a* of spring cam member 30 and glide 40 being biased into engagement with the stop 50 at all times and for all operative hinge positions.

Operation of the hinge assembly 10 is best described with reference to FIGS. 4–7. FIG. 4 shows the door mounting lever 20 in its first operative position corresponding to the "closed" position of a door D connected thereto, where the door mounting lever is moved a maximum extent in a first direction. When the door mounting lever 20 is located in its first operative position, the glide 40 is seated in the second dwell point 50*d* of stop 50. Peak 50*e* of stop 50 is conformed with converging outer surfaces 50*e*1,50*e*2 (FIG. 8), and engagement of glide 40 with surface 50*e*1 under biasing force of spring 60 urges the spring cam member 30 toward first end 14*a* of main channel member 14 (i.e., downward in FIG. 4) so that door mounting lever 20 is held firmly in is first operative position. In other words, the peak 50*e* is conformed so that when the glide 40 is urged inward toward wall 14*i* of channel member 14, the glide 40 is urged by surface 50*e*1 of peak 50*e* toward the first end 14*a* of the main channel member 14 to pull the lever 20 into its first operative position as shown. In the case where the hinge assembly 10 is used in an oven environment, this ensures that the door D connected to lever 20 will tightly mate with the opening of the cooking chamber defined by the oven chassis C.

Figure 5:
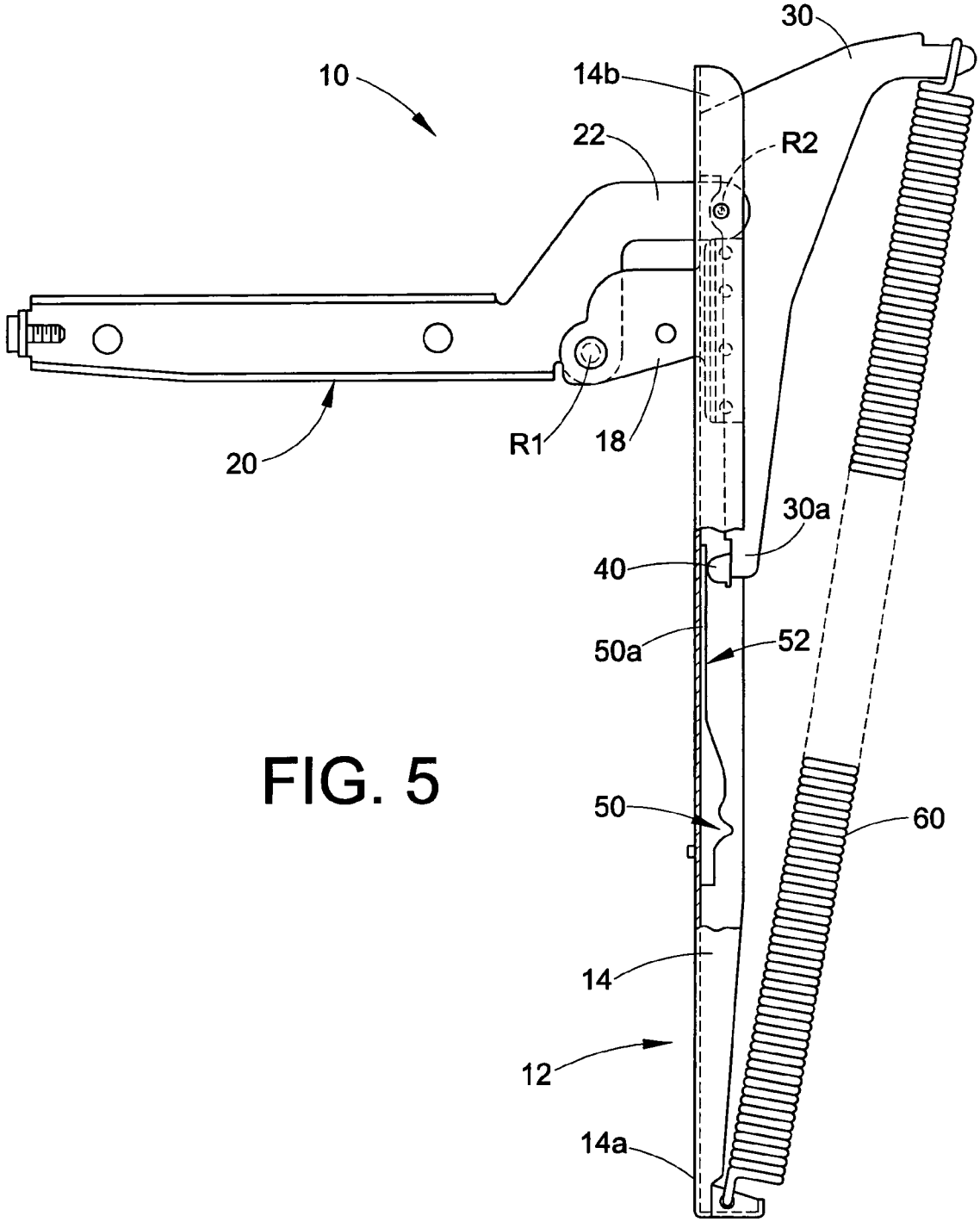

In FIG. 5, the door mounting lever 20 is pivoted against the biasing force of spring 60 a maximum distance away from the channel 12 in a second direction opposite the first direction to a second operative position corresponding to the fully opened position for the appliance door connected thereto. In the illustrated embodiment, the second operative position is defined by the position of the door mounting lever 20 in which the tail 22 thereof engages the main channel member 14 which acts as a stop to prevent further pivoting movement of the lever 20 about the fastener R1. When the door mounting lever 20 is pivoted from the first operative position (FIG. 4) to the second operative position (FIG. 5), tail 22 of the lever 20 moves the spring cam member 30 toward the second end 14*b* of the main channel member 14 which results in the glide 40 moving slidably out of the second dwell point 50*d*, over the peak 50*e* and first dwell point 50*c*, over the camming surface 50*b* to a position where the glide 40 is engaged with glide surface 52 of the tail portion 50*a* of the stop 50. As previously noted, at all times, the biasing force of spring 60 on second end 30*b* of spring cam member 30 results in the glide 40 being continuously urged into abutment with the stop 50 as it moves slidably thereon. The weight of the door D connected to the lever 20 is sufficient to overcome the biasing force of spring 60 when the mounting lever 20 is in the second operative (fully opened) position as shown in FIG. 5.

Figure 6:
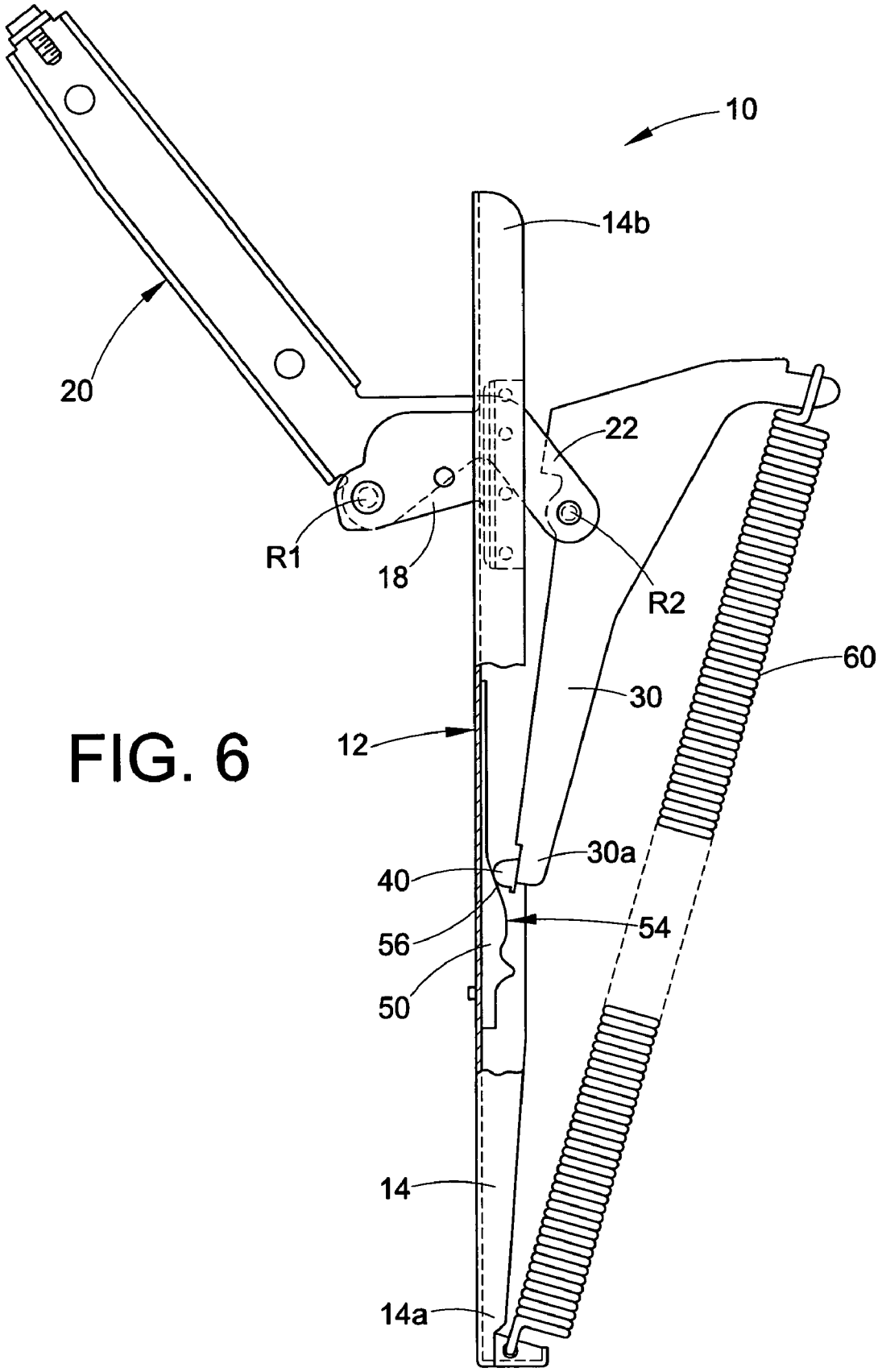

Pivoting movement of the door mounting lever 20 from the second operative (fully opened) position toward the first operative (fully closed) position results in the glide member 40 moving sliding on the glide surface 52 of tail 50*a* toward the transition glide surface 56 and camming glide surface 54 as shown in FIG. 6. It should be noted that the glide 40 maintains in contact with stop 50 at all times and does not contact wall 14*i* of channel.

Continued movement of the door mounting lever 20 from the third (intermediate) position shown in FIG. 6 toward the first operative (fully closed) position result in sliding movement of glide 40 over convexly curved cam glide surface 56. As glide 40 moves slidably over cam glide surface 56, it is moved away from the inner wall 14*i* of the main channel member 14 which counteracts natural shortening of the spring 60 (because the second end of spring cam member 30 is pivoted away from the first end of spring 60*a* when the glide 40 moves slidably up the cam glide surface 56). This action improves counterbalance and feel of the hinge assembly 10.

Figure 7:
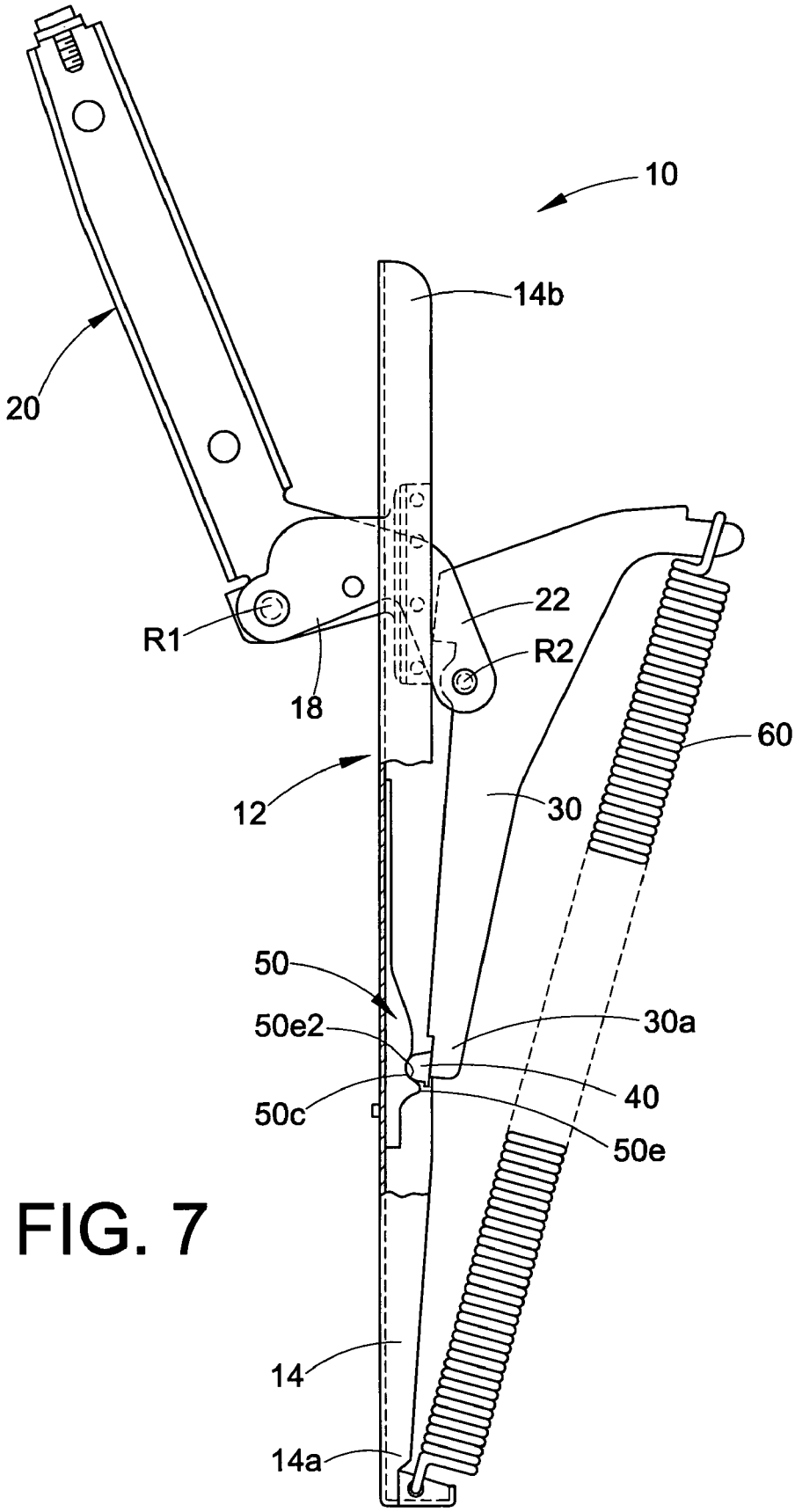

Upon sufficient pivoting of the door mounting lever 20 toward the first operative position, the glide 40 will eventually move slidably over the cam glide surface 56 and seat in the first dwell point 50*c* which defines a fourth operative position corresponding to a broil position for the door D connected to the door mounting lever 20. When the glide 40 is located in the first dwell point 50*c*, the biasing force of the spring 60 causes the glide 40 to bear against the sloped outer surface 50*e*2 of the peak 50*e* which maintains glide 40 in the dwell point 50*c*, i.e., the surface 50*e*2 is sloped in a manner so that the inward biasing force of spring 60 is used to prevent the glide 40 from moving from the first dwell point 50*c* over the peak 50*e* into the second dwell point 50*d*. As such, when the hinge assembly 10 is in its fourth operative (broil) position, as shown in FIG. 7, the biasing force of the spring 60 is fully counterbalanced by the weight of the door D connected to lever 20 and by engagement of glide 40 with first dwell point 50*c* so that manual force need not be applied to the door D to hold same in the fourth operative (broil) position. Of course, the door D and lever 20 can be moved to the first operative (fully closed) position by simple application of manual force in that direction so that the glide 40 moves over peak 50*e* of stop 50 and into the second dwell point 50*d* as shown in FIG. 4.

Owing to the design described herein, the performance characteristics of the hinge assembly 10 can be altered by simply altering the profile of the stop 50 and/or the materials from which the stop and/or glide are defined. For example, use of a low friction material for the glide and/or stop will result in a hinge assembly 10 that exhibits quicker, lighter travel and feel. Conversely, use of higher friction materials for the glide and/or stop will result in a hinge assembly 10 that exhibits slower, heavier travel and feel.

It is preferred that the channel 12 including main channel member 14 and tab 18, door mounting lever 20 and spring cam member 30 each be defined from one or more metal stampings, although other materials can be used. The spring 60 is preferably a metallic coil spring, although other types of springs and spring materials can be used without departing from the overall scope and intent of the present development. As noted, the stop 50 is preferably defined as a one-piece construction from a molded plastic material such as Nylon or a filled Nylon material, but the stop can also be defined from metal or other suitable metallic or non-metallic materials and need not be one-piece. The glide 40 is also preferably defined from molded plastic material such as Nylon or filled Nylon or another suitable material that is affixed to the first end 30*a* of the spring cam member 30 as shown by adhesive, over-molding, a fastener or simply by means of a friction fit or otherwise. In an alternative embodiment, the glide 40 can be formed from metal and/or can be formed as a one-piece construction with the spring cam member 30, itself, as part of the metal stamping from which the spring cam is defined. It is not intended that the invention be limited to these or any other particular materials. Also, unless stated otherwise, all components, members and the like, regardless of name, can be defined as one-piece constructions or can be assembled or fabricated from multiple parts. While one spring 60 is shown, the hinge assembly can comprise multiple springs for biasing the door mounting lever and glide. Although references are made herein to use of the hinge assembly 10 for connecting an oven door to an oven body or chassis, it is not intended that the hinge assembly 10 be limited to use in such environment, and the hinge assembly 10 is suitable for use alone or in a set to secure a door pivotally to a support structure in any other appliance or other environment.

The invention has been described with reference to preferred embodiments. Modifications will occur to those of ordinary skill in the art to which the invention pertains upon reading this specification. It is intended that the claims be construed to encompass all such modifications and alterations to the fullest extent permitted by law.

We claim:

1. A hinge assembly comprising:

a channel comprising first and second opposite ends;

a stop defined separately from and immovably connected to said channel between said first and second ends, said stop comprising at least one dwell point and comprising a glide surface including a tail portion and a curved camming portion;

a door mounting lever that pivots relative to said channel about a pivot axis on an arc between a first operative position where said door mounting lever is moved a maximum extent in a first direction about said pivot axis on said arc and second operative position where said door mounting lever is moved a maximum extent in a second direction opposite the first direction about said pivot axis on said arc;

a glide operatively coupled to said door mounting lever and movable relative to said channel toward and away from said first and second opposite ends of said channel slidably on both said tail and curved camming portion of said glide surface of said stop and selectively seatable in said at least one dwell point in response to movement of said door mounting lever; and, a spring that biases said glide into continuous engagement with said stop when said door mounting lever is located in both said first and second operative positions and when said door mounting lever moves between said first and second operative positions.

2. A hinge assembly as set forth in claim 1, further comprising:

a spring cam member pivotally connected to said door mounting lever and including said glide, wherein said spring extends between an anchor point and said spring cam member.

3. A hinge assembly comprising:

a channel;

a stop defined separately from and immovably connected to said channel;

a door mounting lever that pivots relative to said channel about a pivot axis on an arc between a first operative position where said door mounting lever is moved a maximum extent in a first direction about said pivot axis on said arc and second operative position where said door mounting lever is moved a maximum extent in a second direction opposite the first direction about said pivot axis on said arc;

a glide operatively coupled to said door mounting lever and movable slidably on said stop and selectively in response to movement of said door mounting lever; and, a spring that biases said glide into continuous engagement with said stop when said door mounting lever is located in both said first and second operative positions and when said door mounting lever moves between said first and second operative positions;

a spring cam member pivotally connected to said door mounting lever and including said glide, wherein said spring extends between an anchor point and said spring cam member, wherein said door mounting lever comprises a tail that projects through said channel and wherein said spring cam member is pivotally connected to said tail of said-door mounting lever.

4. The hinge assembly as set forth in claim 2, wherein said spring cam member is pivotally connected to said door mounting lever at a pivot point located between first and second ends of said spring cam member, and wherein said glide is located at said first end of said spring cam member and said spring is connected to a second end of said spring cam member.

5. The hinge assembly as set forth in claim 4, wherein said anchor point to which said spring is connected is an anchor point connected to said channel.

6. The hinge assembly as set forth in claim 2, wherein said glide is formed as a one-piece construction with said spring cam member.

7. The hinge assembly as set forth in claim 2, wherein said glide comprises a plastic material and is secured to said spring cam member.

8. The hinge assembly as set forth in claim 1, wherein said stop comprises at least two separate dwell points separated from each other by a peak portion, said peak portion comprising first and second sloped outer surfaces that converge with each other to define said peak portion.

9. A hinge assembly comprising:

a channel;

a stop connected to said channel;

a door mounting lever that pivots relative to said channel about a pivot axis on an arc between a first operative position where said door mounting lever is moved a maximum extent in a first direction about said pivot axis on said arc and second operative position where said door mounting lever is moved a maximum extent in a second direction opposite the first direction about said pivot axis on said arc;

a glide operatively coupled to said door mounting lever and movable slidably on said stop in response to movement of said door mounting lever, wherein said stop defines a glide surface on which said glide moves slidably relative to said stop, said glide surface comprising a tail portion that lies parallel to a wall of said channel against which said stop is abutted and a curved camming portion, and wherein said stop further comprises at least one dwell point in which said glide selectively seats; and, a spring that biases said glide into continuous engagement with said stop when said door mounting lever is located in both said first and second operative positions and when said door mounting lever moves between said first and second operative position.

10. The hinge assembly as set forth in claim 1, wherein said stop comprises a one-piece molded construction comprising a plastic material or a filled-plastic material.

11. The hinge assembly as set forth in claim 1, wherein said curved camming portion of said stop comprises a convexly curved portion and a concavely curved portion that interconnects said convexly curved portion to said tail portion.

12. An appliance hinge assembly comprising:

a metal channel adapted for connection to an appliance chassis, said channel comprising a main channel member comprising first and second ends and defining a recess between an inner wall and first and second sidewalls;

a plastic stop located in said recess of said main channel member, said stop comprising a glide surface spaced above said inner wall of said main channel member;

a door mounting lever adapted for connection to an appliance door and movable relative to said channel about a pivot axis;

a glide operably coupled to said door mounting lever and movable slidably on said glide surface of said stop toward and away from said first and second ends of said main channel member in response to movement of said door mounting lever relative to said channel; and, at least one spring for biasing said door mounting lever to a first operative position and for biasing said glide into abutment with said stop for all pivoting operative movement of said door mounting lever about said pivot axis.

13. The appliance hinge assembly as set forth in claim 12, wherein said stop is secured in said recess of said channel by a fastener.

14. The appliance hinge assembly as set forth in claim 13, wherein said stop comprises a one-piece molded construction comprising a polymeric material.

15. The appliance hinge construction as set forth in claim 14, wherein said polymeric material comprises Nylon.

16. The appliance hinge assembly as set forth in claim 13, wherein said fastener is countersunk into said stop.

17. The appliance hinge assembly as set forth in claim 12, wherein said glide is operably connected to said door mounting lever by a spring cam member that is pivotally connected to said door mounting lever, said glide located at a first end of said spring cam member and said at least one spring connected to a second end of said spring cam member.

18. A hinge assembly comprising:

a channel comprising first and second axially spaced-apart ends and defining a recess between an inner wall and first and second spaced-apart sidewalls;

a door mounting lever pivotally connected to said channel for pivoting movement about a pivot axis on an arc between a first operative position and a second operative position;

a spring cam member connected to the door mounting lever;

a glide located at a first end of the spring cam member;

a stop immovably connected to said channel and comprising a glide surface including a flat tail portion including a tail glide surface spaced above said inner wall of said channel and a cam portion including a convexly curved cam glide surface, said stop further defining a dwell point connected to said cam glide surface, wherein said glide moves slidably on said glide surface and is in continuous contact with said stop when said door mounting lever moves to and between said first and second operative positions on said arc, wherein said stop lies between said glide and said inner wall of said channel for all positions of said door mounting lever.

* * * * *